US009845586B2

(12) United States Patent
Armstrong

(10) Patent No.: US 9,845,586 B2
(45) Date of Patent: Dec. 19, 2017

(54) MANHOLE FRAME WITH ONE OR MORE HANDHOLDS

(71) Applicant: Ronald Armstrong, Abbotsford (CA)

(72) Inventor: Ronald Armstrong, Abbotsford (CA)

( * ) Notice: Subject to any disclaimer, the term of this patent is extended or adjusted under 35 U.S.C. 154(b) by 69 days.

(21) Appl. No.: 14/899,482

(22) PCT Filed: Jul. 8, 2014

(86) PCT No.: PCT/CA2014/050649

§ 371 (c)(1),
(2) Date: Dec. 17, 2015

(87) PCT Pub. No.: WO2015/010196

PCT Pub. Date: Jan. 29, 2015

(65) Prior Publication Data

US 2016/0145826 A1 May 26, 2016

Related U.S. Application Data

(60) Provisional application No. 61/856,912, filed on Jul. 22, 2013.

(51) Int. Cl.
*E02D 29/14* (2006.01)
*E02D 29/12* (2006.01)

(52) U.S. Cl.
CPC ..... *E02D 29/122* (2013.01); *E02D 29/14* (2013.01)

(58) Field of Classification Search
CPC ..... E02D 29/122; E02D 29/14
USPC ..... 404/25; 52/19
See application file for complete search history.

(56) References Cited

U.S. PATENT DOCUMENTS 3,745,738 A * 7/1973 Singer ..... E02D 29/12 264/34
4,472,911 A * 9/1984 Jooris ..... E03F 5/02 404/25
4,666,333 A 5/1987 Armstrong
5,634,739 A 6/1997 Armstrong
5,931,258 A * 8/1999 Lorentz ..... E06C 7/182 182/106
8,858,114 B2 * 10/2014 Gaspar ..... E02D 29/12 404/25
2008/0098662 A1 * 5/2008 Laffitte Figueras .... E02D 29/14 52/20
2010/0193293 A1 8/2010 Murray et al.
(Continued)

FOREIGN PATENT DOCUMENTS

JP 09158231 A 6/1997
JP 2000027220 A 1/2000
(Continued)

OTHER PUBLICATIONS

International Search Report for PCT/CA2014/050649 dated Sep. 4, 2014.

*Primary Examiner* — Raymond W Addie
(74) *Attorney, Agent, or Firm* — Bruce M. Green; Oyen Wiggs Green & Mutala, LLP

(57) ABSTRACT

A manhole frame includes one or more handholds near the entrance to the manhole so that the ladder rungs can be made lower and the access space at the entrance to the manhole thereby increased. The handhold can be cast into the cover-supporting lip, or can be a movable handle which is below the level of the manhole when not in use or extended above ground level when in use.

8 Claims, 7 Drawing Sheets

(56) References Cited

U.S. PATENT DOCUMENTS

| | | | | |
|---|---|---|---|---|
| 2012/0297691 | A1 | 11/2012 | Gaspar | |
| 2014/0311048 | A1* | 10/2014 | Hill | E02D 29/1445 52/19 |

FOREIGN PATENT DOCUMENTS

| | | | |
|---|---|---|---|
| JP | 2007002481 | A | 1/2007 |
| KR | 1020140035110 | A | 3/2014 |

* cited by examiner

MANHOLE FRAME WITH ONE OR MORE HANDHOLDS

CROSS REFERENCE TO RELATED APPLICATION

The present application claims the benefits, under 35 U.S.C. §119(e), of U.S. Provisional Application Ser. No. 61/856,912 filed Jul. 22, 2013 which is incorporated herein by this reference.

TECHNICAL FIELD

The invention relates to the field of manhole construction. More particularly, the invention relates to methods for incorporating one or more handholds into a manhole frame and also into the concrete support structure of a manhole frame.

BACKGROUND

It is typical of manholes to have step rungs placed in the manhole structure to provide a continuous ladder of equally placed step rungs within the manhole. The rungs for the ladder are typically spaced 12 inches apart. The maximum allowable distance from the top of the manhole frame to the first step rung in the manhole is 20 inches. The manhole frame adjustment space between the top of the concrete manhole and the underside of the manhole frame is typically filled by layering bricks or concrete rings and mortar. A step rung is typically placed in this area so as to continue the even step rung placing toward the top of the manhole frame. The top of the manhole frame is typically set flush with the asphalt or concrete surface of the roadway. The adjustment area below the base of the frame is typically maintained at the same diameter as the opening of the top of the concrete manhole opening. Step rungs placed into the wall of the adjustment space must be embedded three inches deep and extend four inches outward from the point of embedment. The placement of the step rung into the adjustment space reduces the space available for a worker passing the step rung at this point. The spacing of the step rung and the allowable minimums of the reduced area between the outermost extension of the embedded step rung and the opposite side of the wall of the adjustment area however may still fall within the generally accepted Occupational Health and Safety standards.

Some jurisdictions state that if a handhold is placed into the manhole frame adjustment area, the distance from the top of the manhole frame to the first step rung in the manhole may be extended from twenty inches to twenty six inches. Handholds are not typically required to be spaced evenly as with step rung requirements and therefore may be spaced considerably above the last designated step rung in the manhole and still comply with Occupational Health and Safety standards. It is therefore desirable to meet these safety requirements using a method that reduces the width of the access area of the manhole frame adjustment area to a lesser degree than is now typical using the continuous step rung procedure.

The present inventor is also the inventor of the manhole casting positioning apparatus disclosed in U.S. Pat. No. 4,666,333 issued May 19, 1987. Manholes for sewers and the like are typically assembled by stacking a number of precast, cylindrical concrete barrel sections to approximately the desired height. In order to allow some adjustability of the placement of the iron manhole casting on the end of the manhole in relation to the road grade, a 1-inch to 8-inch space is typically left between the manhole and the iron casting. Previously this space was filled with layers of bricks, which is expensive and time consuming. The apparatus disclosed in U.S. Pat. No. 4,666,333 provides a two-piece form, consisting of an inner and outer sleeve, which replaces the brick and mortar method.

In the inventor's apparatus disclosed in U.S. Pat. No. 4,666,333, the inner sleeve may consist of a single plastic piece joined end-to-end to form a cylinder which is expandable by means of turnbuckle-type expansion mechanisms. The outer sleeve may be in the form of a belt with a receptacle at one end through which the other end passes and is secured to form a cylinder. The inner sleeve is first expanded into the manhole opening and set to the required slope. The casting is mounted on the inner sleeve, and the outer sleeve, which has a diameter greater than that of the base of the casting, is placed around the casting. Concrete is then poured between the inner and outer sleeves and up over the base of the casting. After the concrete has set the outer sleeve is removed, and the inner sleeve can be removed or left in place.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

The present invention therefore provides a handhold in a manhole frame where the handhold is provided in the annular cover-supporting lip of the manhole frame. The handhold may be cast into the frame at the time of production, welded to the frame and/or a handhold may be mechanically attachable/detachable to the annular lip or manhole frame. A further variation of the handhold which allows the handhold to rise above the top of the frame and provide a secure hand hold above the frame top elevation is also provided.

The manhole frame may have one or more handholds attached to the manhole frame to facilitate a person to enter or exit the manhole. The handhold is preferably located in the manhole frame close to the upper opening of the manhole. The handhold is preferably smaller than a ladder rung and protrudes radially into the manhole opening a shorter distance than the ladder rungs to improve access. The handhold may be vertically or horizontally oriented. In some embodiments, the area of the manhole frame behind the handhold can be recessed so as to reduce the protrusion of the handhold into the manhole opening while permitting sufficient space for a hand. Forming the handle in part from loose link chain or wire rope can also be done to add flexibility and resilience for additional space for a hand. The handhold may be movable between a first position wherein the handhold extends above ground and a second position wherein the handhold is stowed below ground when not in use.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
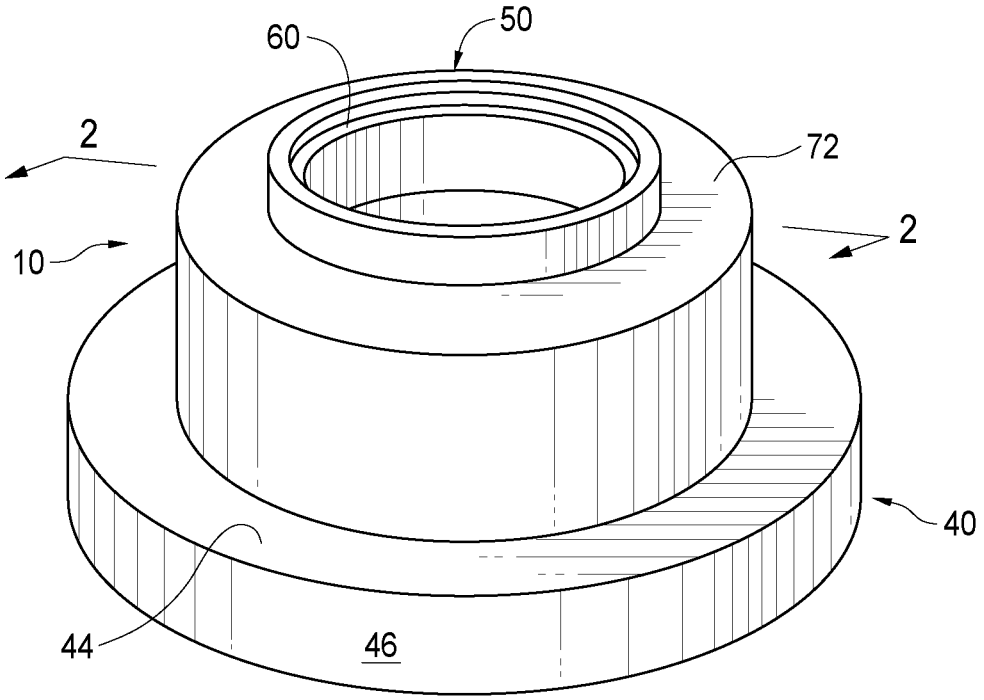
FIG. 1 is a perspective view of a manhole casting cemented in place on a manhole using the inventor's apparatus as disclosed in U.S. Pat. No. 4,666,333.
Figure 2:
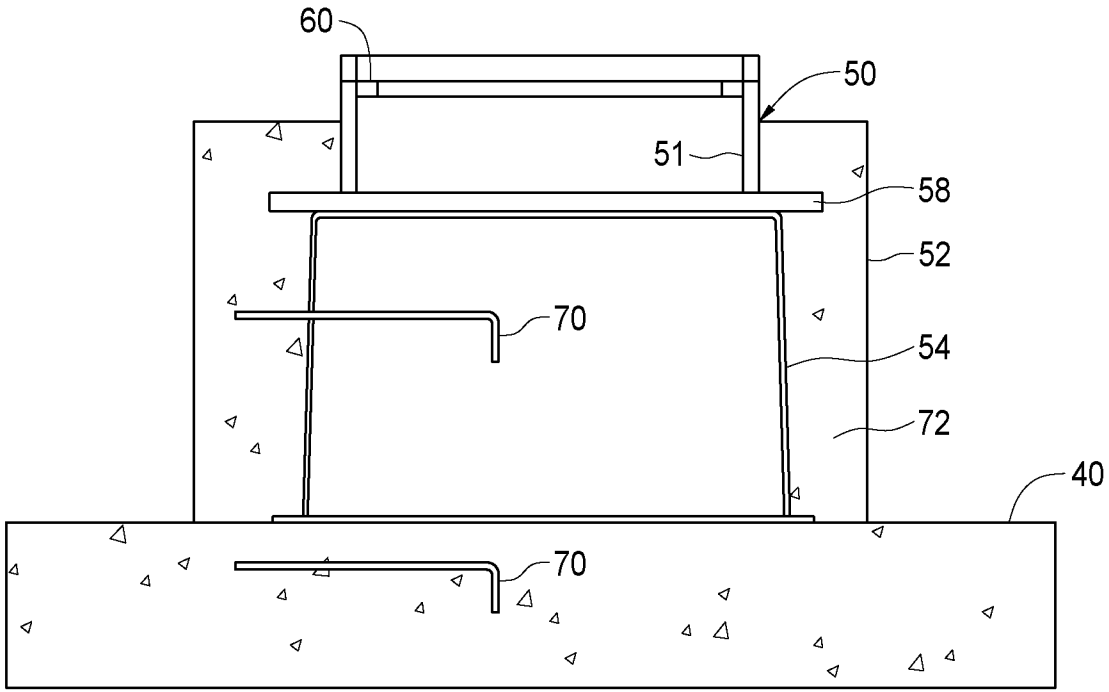
FIG. 2 is a cross-section taken along lines 2-2 of FIG. 1.

FIGS. 1 and 2 illustrate a manhole 10 with the upper end 40 of the manhole having outer side 46 and upper surface 44. Manhole frame 50, also referred to as a manhole casting, is secured to manhole upper end 40 by concrete casing 72, such as by using the inventor's manhole casting positioning apparatus as disclosed in U.S. Pat. No. 4,666,333, formed using inner sleeve 54 and outer surface 52 formed by the outer sleeve (not shown). Frame 50 has an upper annular lip 60 for receiving a manhole cover, vertical wall 51 and frame base 58. Ladder rungs of existing configuration and location are shown at 70.

Figure 3:
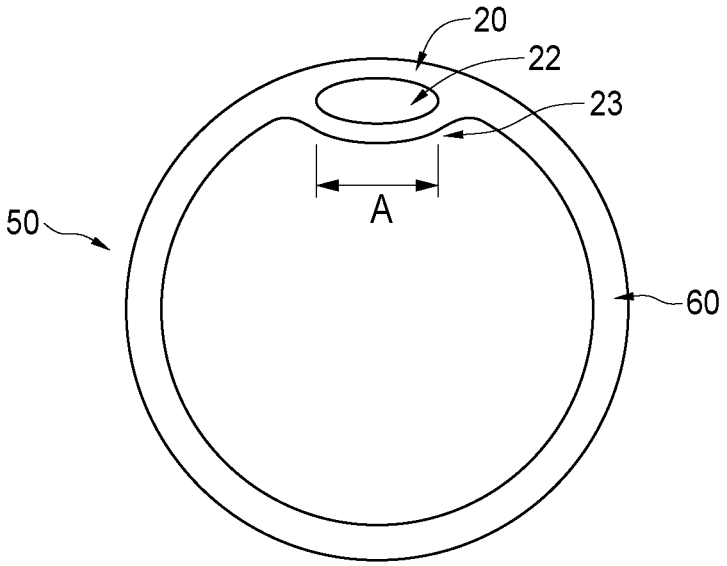
FIG. 3 is a top view of a first embodiment of the invention.

Referring to FIG. 3, handhold 20 is cast into the annular lip 60 of manhole frame 50 at the time of production of manhole frame 50, or welded to the annular lip 60 of manhole frame 50. The handhold 20 may be either oriented horizontally as shown in FIG. 3 or vertically. It is formed by providing an opening 22 having a radial dimension of about 2½ inches and a circumferential dimension of about 5 inches, on the interior side of which is handle 23 which is about ¾ inches wide. Preferably the upper edge of handle 23 is set slightly lower than or flush with the upper surface of annular lip 60 so that the bottom of the manhole cover does not rest on handle 23. Handle 23 can be made to protrude radially inwardly from the manhole frame so as to be convex, but the shape of handle 23 can also be straight across, or curved radially outwardly towards frame 50 so as to be concave. In the latter case, the area of the manhole frame behind the handle would be concave, proportional to the handle, to provide adequate clearance for a worker's hand.

Figure 4:
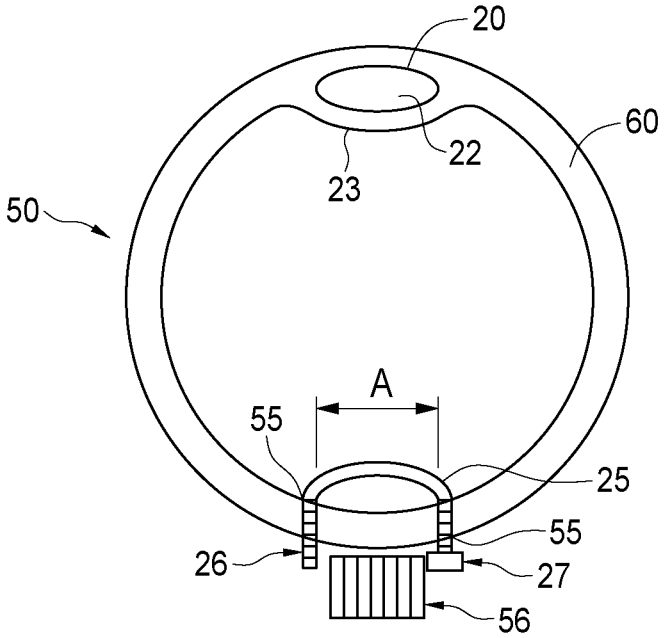
FIG. 4 is a top view of a second embodiment of the invention.
Figure 5:
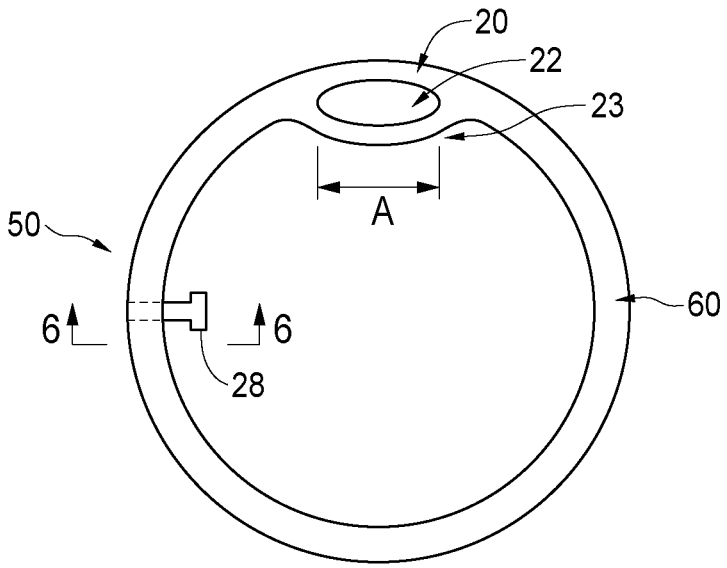
FIG. 5 is a top view of a third embodiment of the invention.
Figure 6:
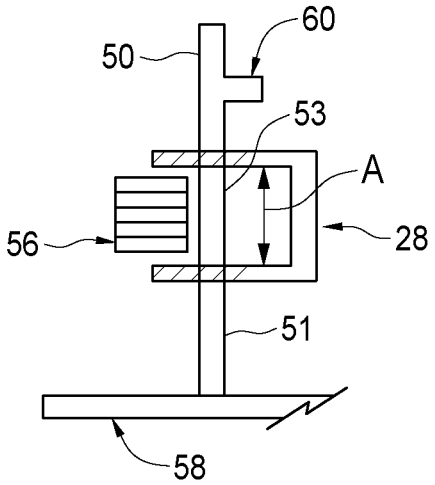
FIG. 6 is a cross-section taken along lines 6-6 of FIG. 5 illustrating the third embodiment of the invention.

Alternately as shown in FIG. 4 a handhold 25 is mechanically attached to a pre-manufactured manhole frame 50. The handhold 25 is mechanically attached to a pre-manufactured manhole frame by drilling holes 55 into the manhole frame 50 a few inches below annular lip 60 and securing a handhold 25 to the manhole frame, for example by making ends 26 of handhold 25 threaded and using nuts 27 to secure the handhold to the frame 50. Alternatively handhold 25 can be provided with holes to receive threaded bolts which extend through frame 50. The handhold 25 can be oriented horizontally or vertically. FIGS. 5 and 6 illustrate handhold 28 in vertical orientation. The handhold may be made of rigid steel, or of loose link chain or wire rope to provide flexibility and resilience. The handhold may be manufactured to be straight, concave or convex as required, with the inner surface 53 of the frame 50 behind handhold 28, shown in front view as a separate detail view 56 in FIG. 4 and FIG. 6, recessed at 56 as necessary for clearance. Where bolts are used, the same handhold can provide either a concave or convex shape by reversing the handhold. Preferably the width A of the space formed between the handhold 23/25/28 and frame 50 is about 5 inches.

Figure 7:
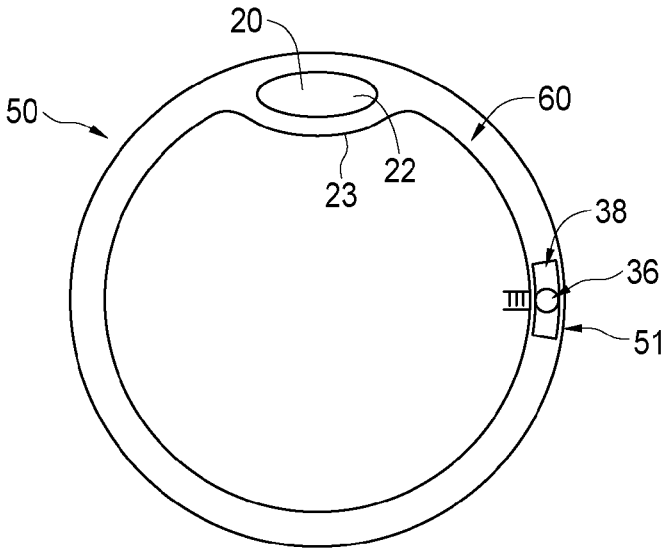
FIG. 7 is a top view of a fourth embodiment of the invention.
Figure 8:
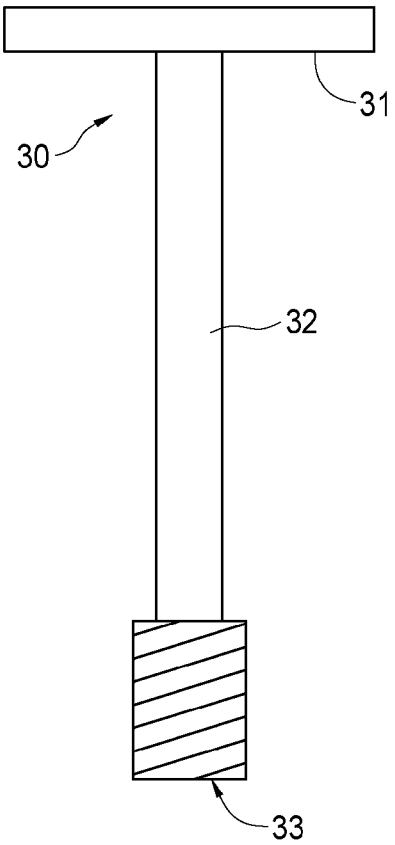
FIG. 8 is a front view of the handhold shown in FIG. 7.

FIGS. 7 and 8 illustrates a handhold which moves vertically to extend above ground level. T-shaped handhold 30 has a horizontal bar 31, vertical bar 32 which has threaded end 33 which threads into threaded hole 36 in annular lip 60 of frame 50. The diameter of vertical bar 32 is slightly less than the diameter of threaded end 33. A horizontal recess 38 in annular lip 60 receives bar 31 when the T-handle is threaded completely through the threaded hole 36 and vertical bar 32 then drops through hole 36. This latter handhold may also serve as an easily accessible attachment point for life lines attached to a worker in a manhole when the handhold is extended above the manhole frame. A locking nut (not shown) may then be threaded onto threaded end 33 to make the T-shaped handhold 30 an integral part of the frame 50. The handhold 30 may be made flexible and resilient by forming part of vertical bar 32 from wire rope. This can be done by welding one end of a wire rope to a shortened vertical bar 32 a couple of inches below horizontal bar 31, and welding the threaded end 33 to the other end of the wire rope. In this way the handhold 30 is resilient and flexible so a worker grasping the handhold can draw it away from frame 50 providing extra clearance for the worker's hand. Loose link chain mat also be substituted for the wire rope.

Figure 9:
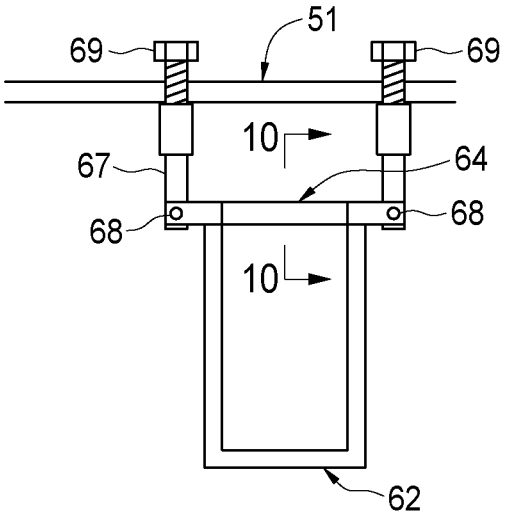
FIG. 9 is a front view of a fifth embodiment of the invention, with the handhold shown extending horizontally.
Figure 10:
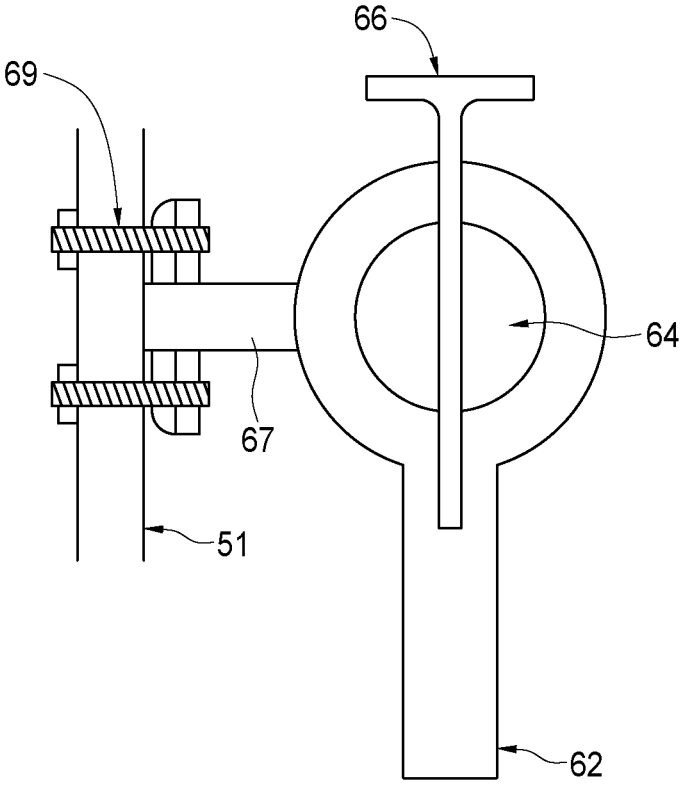
FIG. 10 is a cross-section view of the handhold shown in FIG. 9 taken along lines 10-10, with the handhold extending vertically downwardly.

FIGS. 9 and 10 illustrate a handhold 62 which can be rotated to a position above ground when the manhole cover is removed for workers. Handhold 62 rotates freely 180 degrees on axle 64 from a vertical orientation extending downwardly as shown in FIG. 10, to a position where handhold 62 extends vertically above ground level. Axle 64 is mounted on support element 67 which is secured to manhole frame 50 by bolts 69. Two pins 66 removably extend through holes 68 in support element 67 and handhold 62 to releasably hold handhold 62 in the up or down position depending on whether the manhole is in use.

Figure 11:
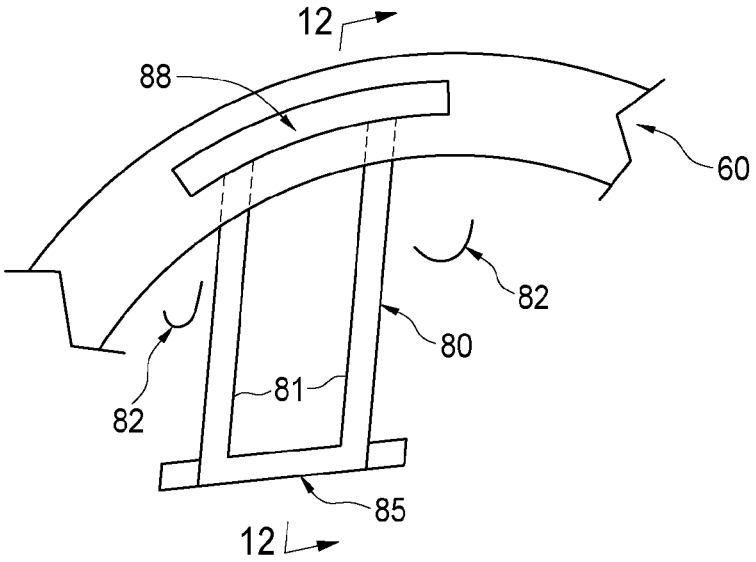
FIG. 11 is a front view of a sixth embodiment of the invention.
Figure 12:
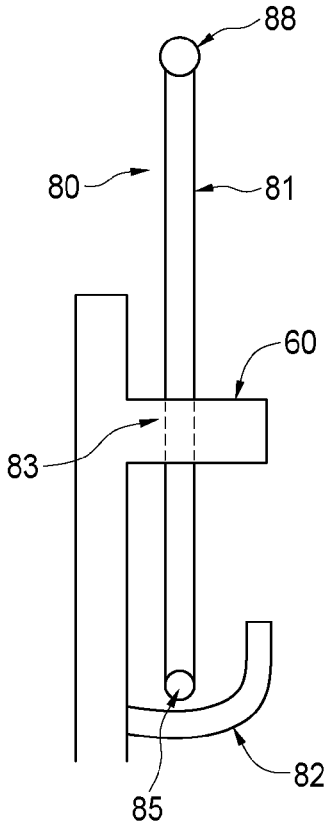
FIG. 12 is a cross-section view of the handhold shown in FIG. 11 taken along lines 12-12 when placed in the upper position.

FIGS. 11 and 12 illustrate a handhold 80 which can be extended vertically and supported by hooks 82 in a position above ground when the manhole cover is removed for workers. Handhold 80 has horizontal upper bar 88, vertical shanks 81 and lower horizontal bar 85 which sits on hooks 82 when in the upper position shown in FIG. 12. Vertical shanks 81 extend through holes 83 in annular lip 60. Holes 83 are wide enough to allow shanks 81 to tilt to allow lower end 85 to pass around hooks 82. The upper surface of annular lip 60 can be recessed to receive upper bar 88 so that the surface is flush to receive a manhole cover when the handhold 80 is in the lower position shown in FIG. 11. When extended upwardly the handholds shown in FIG. 7-12 may also serve as an easily accessible attachment point for life lines attached to a worker in a manhole.

Two piece manhole frames, comprising the manhole casting 50 and an inner support sleeve or riser 54 may have these methods applied to either or both of the manhole frames and base 50 and/or riser (inner sleeve) 54 sections. In the latter case holes for the extended arms of the handhold 23/25/28/30/62/80 are provided in the inner sleeve 54 higher up toward the base of the manhole frame. As noted above, the handhold is not required to be set in a continuous even spacing as required for a step rung placement. The handhold need not protrude as far from the frame 50 or inner sleeve 54 at the point of embedment as a step rung, allowing for a greater access area in the entrance to the manhole than the step rung placement procedure.

With regard to the various methods described above, once the handhold has been incorporated into the manhole casting, the casting 50 is imbedded into the concrete support structure 72. Modifications to the design and placement of the handholds may be made to accommodate different sizes and styles of manholes. A handhold can be placed in a horizontal orientation while a vertical orientation would clearly distinguish it from a step rung as a handhold.

The manhole thus in this way may have one or more handholds attached to the manhole frame to facilitate a person to enter or exit the manhole. The handhold is located close to the upper opening of the manhole. The handhold is smaller than a ladder rung and protrudes preferably about 2 inches or less radially inwardly into the manhole opening from the inner edge of the annular lip 60. The handhold can be vertically or horizontally oriented. In some embodiments, the area behind the handhold may be recessed so as to reduce the protrusion of the handhold into the manhole opening. According to one variation the handhold is movable between a first position wherein the handhold extends above ground in use and a second position wherein the handhold is stored below ground when the manhole cover is closed.

While a number of exemplary aspects and embodiments have been discussed above, those of skill in the art will recognize certain modifications, permutations, additions and sub-combinations thereof. It is therefore intended that the invention be interpreted to include all such modifications, permutations, additions and sub-combinations as are within their true spirit and scope.

What is claimed is:

1. A manhole frame for a manhole, said manhole frame comprising a vertically extending hollow cylinder open at its top and bottom ends, said manhole comprising a plurality of vertically spaced ladder rungs, said manhole frame comprising an annular lip having an upper manhole cover-supporting surface and extending inwardly from said vertically extending cylinder adjacent the upper edge of said vertically extending cylinder, wherein said manhole frame comprises a handhold to facilitate a person to enter or exit the manhole, said handhold being located in the manhole frame above the uppermost of said ladder rungs close to the upper opening of the manhole, being smaller in width than one of said ladder rungs and protruding a radial distance into the manhole opening less than the inward radial protrusion of said ladder rungs.

2. The manhole frame of claim 1 wherein said handhold is provided in said annular lip of said manhole frame.

3. The manhole frame of claim 1 wherein said handhold extends through said annular lip of said manhole frame.

4. The manhole frame of claim 1 wherein said handhold protrudes less than about 2 inches into the manhole opening from the edge of said annular lip.

5. The manhole frame of claim 1 wherein said handhold comprises an opening cast into said annular lip of said manhole frame.

6. The manhole frame of claim 5 wherein the upper surface of said handhold is set flush with or lower than the upper surface of said annular lip.

7. The manhole frame of claim 1 wherein the inner surface said manhole frame in an area radially outwardly of said handhold is recessed so as to reduce the protrusion of the handhold radially inwardly into the manhole opening while permitting sufficient space for a hand.

8. The manhole frame of claim 2 wherein said handhold is horizontally oriented.

* * * * *